US009546556B2

(12) United States Patent
Beattie et al.

(10) Patent No.: US 9,546,556 B2
(45) Date of Patent: Jan. 17, 2017

(54) TURBINE BLADE ROOT PROFILE

(71) Applicant: United Technologies Corporation, Hartford, CT (US)

(72) Inventors: Jeffrey S. Beattie, South Glastonbury, CT (US); Jeffrey Michael Jacques, East Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1259 days.

(21) Appl. No.: 13/626,937

(22) Filed: Sep. 26, 2012

(65) Prior Publication Data

US 2014/0083114 A1 Mar. 27, 2014

(51) Int. Cl.
*F01D 5/30* (2006.01)
*F01D 5/18* (2006.01)

(52) U.S. Cl.
CPC . *F01D 5/30* (2013.01); *F01D 5/18* (2013.01); *F01D 5/3007* (2013.01)

(58) Field of Classification Search
None
See application file for complete search history.

(56) References Cited

U.S. PATENT DOCUMENTS 3,922,109 A 11/1975 Hagen
4,191,509 A * 3/1980 Leonardi ..... 416/219 R
4,260,331 A * 4/1981 Goodwin ..... 416/219 R
5,110,262 A 5/1992 Evans
5,147,180 A * 9/1992 Johnson ..... 416/219 R
5,160,242 A 11/1992 Brown
5,480,285 A * 1/1996 Patel et al. ..... 416/223 A
5,531,569 A * 7/1996 Seeley ..... 416/222
6,019,580 A * 2/2000 Barr et al. ..... 416/219 R
6,416,282 B1 7/2002 Beeck et al.
(Continued)

FOREIGN PATENT DOCUMENTS

EP 2436883 4/2012

OTHER PUBLICATIONS

International Search Report and Written Opinioin for PCT Application No. PCT/US2013/061920 mailed Jul. 10, 2014.
(Continued)

*Primary Examiner* — Dwayne J White
*Assistant Examiner* — Justin Seabe
(74) *Attorney, Agent, or Firm* — Carlson, Gaskey & Olds, P.C.

(57) ABSTRACT

A turbine blade for a gas turbine engine includes an airfoil that extends in a first radial direction from a platform. A root extends from the platform in a second radial direction and has opposing lateral sides that provide a firtree-shaped contour. The contour includes first, second and third lobes on each of the lateral sides and that tapers relative to the radial direction away from the platform. The first, second and third lobes each provide contact surfaces arranged at about 45° relative to the radial direction. A contact plane on each lateral side at an angle of about 11° relative to the radial direction defining a contact point on each of the contact surfaces. The first, second and third lobes each include first, second and third grooves that are substantially aligned with one another along an offset plane spaced a uniform offset distance from the contact plane.

25 Claims, 4 Drawing Sheets

(56) References Cited

U.S. PATENT DOCUMENTS

| | | | | |
|---|---|---|---|---|
| 6,739,836 | B2 * | 5/2004 | Pinzauti et al. | 416/219 R |
| 7,534,085 | B2 | 5/2009 | Pietraszkiewicz et al. | |
| 7,794,208 | B2 * | 9/2010 | Suzuki et al. | 416/219 R |
| 8,251,668 | B2 | 8/2012 | Kasperski | |
| 2007/0237644 | A1 | 10/2007 | Suzuki et al. | |
| 2008/0050238 | A1 | 2/2008 | Durocher et al. | |
| 2009/0022591 | A1 * | 1/2009 | Mujezinovic et al. | 416/219 R |
| 2012/0134834 | A1 | 5/2012 | Virkler et al. | |

OTHER PUBLICATIONS

Extended European Search Report for European Application No. 13864512.2, mailed May 9, 2016.

* cited by examiner

TURBINE BLADE ROOT PROFILE

BACKGROUND

This disclosure relates to a gas turbine engine, and more particularly to a turbine blade root profile.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

Both the compressor and turbine sections may include alternating series of rotating blades and stationary vanes that extend into the core flow path of the gas turbine engine. For example, in the turbine section, turbine blades rotate and extract energy from the hot combustion gases that are communicated along the core flow path of the gas turbine engine. The turbine vanes, which generally do not rotate, guide the airflow and prepare it for the next set of blades.

Turbine blade roots must be securely attached to corresponding rotor slots in the spool-mounted rotor. Root profiles must accommodate many factors, such as centrifugal forces, thermal expansion, and bending stresses. Additionally, the curvature of the airfoil subjects the root to rotational forces. The roots can be configured in various ways to address these issues, such as firtree-shaped root geometries.

SUMMARY

In one exemplary embodiment, a turbine blade for a gas turbine engine includes an airfoil that extends in a first radial direction from a platform. A root extends from the platform in a second radial direction and has opposing lateral sides that provide a firtree-shaped contour. The contour includes first, second and third lobes on each of the lateral sides and that tapers relative to the radial direction away from the platform. The first, second and third lobes each provide contact surfaces arranged at about 45° relative to the radial direction. A contact plane on each lateral side at an angle of about 11° relative to the radial direction defining a contact point on each of the contact surfaces. The first, second and third lobes each include first, second and third grooves that are substantially aligned with one another along an offset plane spaced a uniform offset distance from the contact plane.

In a further embodiment of any of the above, the second lobe is arranged radially between the first and third lobes. The contact points on the second lobe align in an intersecting plane spaced apart from a terminal end of the root a distance. The third lobe is adjacent to the terminal end. The second lobe contact points are spaced apart a contact point distance. The ratio of the contact point distance to the distance is 1.15-1.25.

In a further embodiment of any of the above, the turbine blade includes a cooling passage that extends from the terminal end in the radial direction from the root into the airfoil.

In a further embodiment of any of the above, the first, second and third lobes respectively extend first, second and third lengths beyond the contact plane. The second length is greater than the third length. The first length is greater than the second length. The first, second and third lobes respectively include first, second and third tooth heights lying in the contact plane.

In a further embodiment of any of the above, the second length is 76-82% of the first length.

In a further embodiment of any of the above, the third length is 62-71% of the first length.

In a further embodiment of any of the above, a ratio of the first tooth height to the second tooth height is in the range of 1.060-1.070. A ratio of the first tooth height to the third tooth height is in the range of 1.005-1.015.

In a further embodiment of any of the above, the second and third grooves are provided by a compound radius.

In a further embodiment of any of the above, the second groove includes first and second radii. A ratio of the second radius to the first radius is about 2.5.

In a further embodiment of any of the above, the third groove is provided by third and fourth radii. The ratio of the fourth radius to the third radius is about 2.7.

In a further embodiment of any of the above, the second groove is provided by first and second radii, and the third groove is provided by third and fourth radii. The first and third radii are the same.

In a further embodiment of any of the above, the first and second lobes are provided by a compound radius.

In a further embodiment of any of the above, the first lobe is provided by first and second radii. The ratio of first radius to the second radius is about 1.5.

In a further embodiment of any of the above, the second lobe is provided by third and fourth radii. The ratio of the third radius to the fourth radius is about 1.3.

In a further embodiment of any of the above, the first lobe is provided by first and second radii. The second lobe is provided by third and fourth radii. The second and fourth radii are the same.

In a further embodiment of any of the above, the first and second lobes include non-bearing surfaces opposite the contact surfaces. The non-bearing surfaces at about 5° relative to an intersecting plane normal to the radial direction.

In another exemplary embodiment, a gas turbine engine includes compressor and turbine sections rotatable about an axis, and a combustor section provided axially between the compressor and turbine sections. The turbine section includes a rotor having a slot, and a turbine blade including an airfoil that extends in a first radial direction from a platform. A root of the turbine blade is received in the slot and extends from the platform in a second radial direction and has opposing lateral sides that provide a firtree-shaped contour. The contour includes first, second and third lobes on each of the lateral sides and that tapers relative to the radial direction away from the platform. The first, second and third lobes each provide contact surfaces arranged at about 45° relative to the radial direction, and a contact plane on each lateral side at an angle of about 11° relative to the radial direction that defines a contact point on each of the contact surfaces. The first, second and third lobes each include first, second and third grooves that are substantially aligned with one another along an offset plane spaced a uniform offset distance from the contact plane.

In a further embodiment of any of the above, the first, second and third lobes respectively extend first, second and third lengths beyond the contact plane. The second length is greater than the third length. The first length is greater than the second length. The first, second and third lobes respectively include first, second and third tooth heights lying in the contact plane.

In a further embodiment of any of the above, a ratio of the first tooth height to the second tooth height is in the range of 1.060-1.070. A ratio of the first tooth height to the third tooth height is in the range of 1.005-1.015.

In a further embodiment of any of the above, the second lobe is arranged radially between the first and third lobes. The contact points on the second lobe align in an intersecting plane spaced apart from a terminal end of the root a distance. The third lobe is adjacent to the terminal end. The second lobe contacts points spaced apart a contact point distance. The ratio of the contact point distance to the distance is 1.15-1.25.

In a further embodiment of any of the above, the second and third grooves are provided by a compound radius.

In a further embodiment of any of the above, the first and second lobes are provided by a compound radius.

In a further embodiment of any of the above, the first and second lobes include non-bearing surfaces opposite the contact surfaces. The non-bearing surfaces are at about 5° relative to an intersecting plane normal to the radial direction.

In a further embodiment of any of the above, the non-bearing surfaces of the first and second lobes are spaced from the rotor to provide first and second clearances respectively. The second clearance approximately three times larger than the first clearance.

BRIEF DESCRIPTION OF THE DRAWINGS

The disclosure can be further understood by reference to the following detailed description when considered in connection with the accompanying drawings wherein.

DETAILED DESCRIPTION

Figure 1:
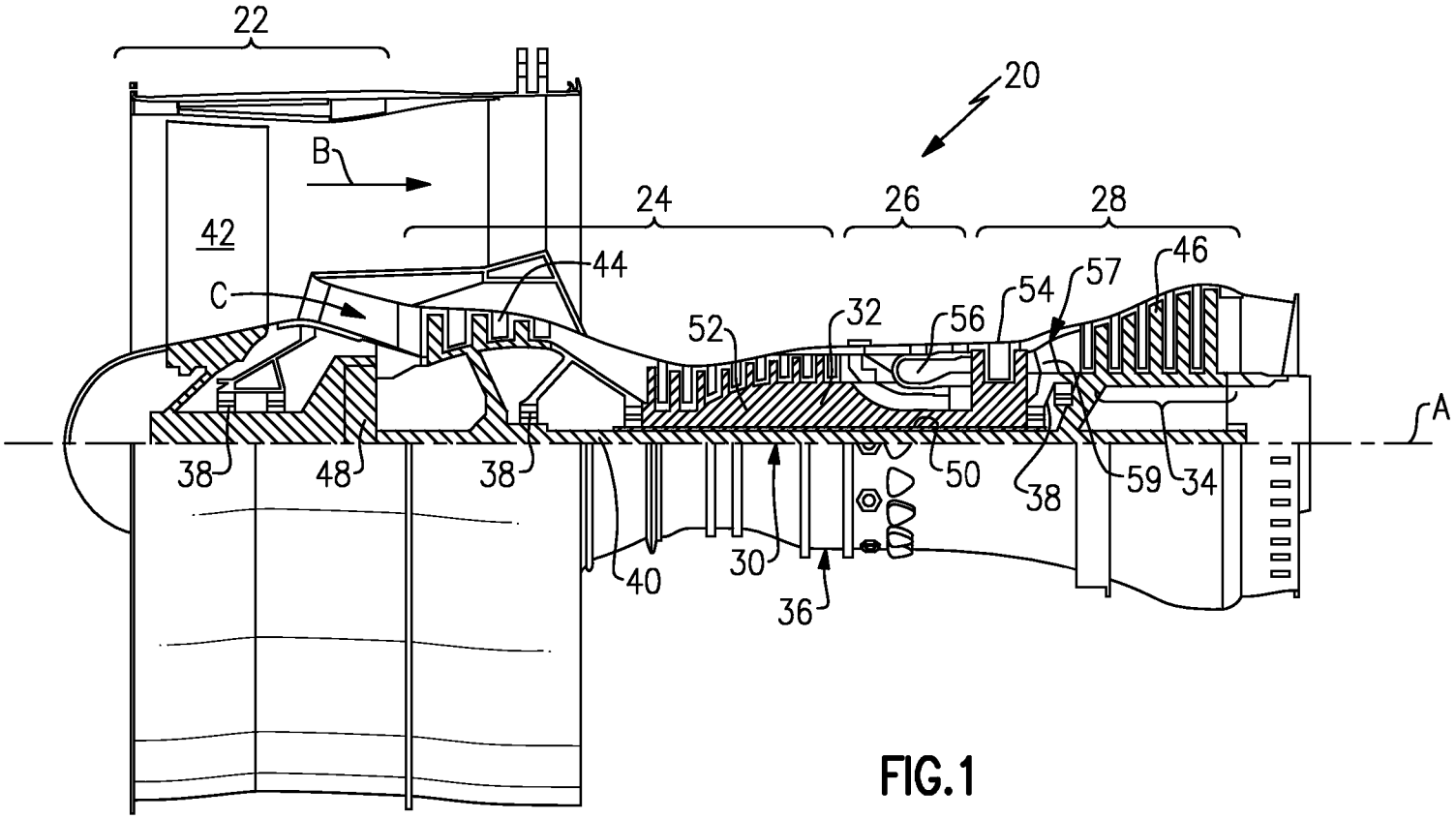
FIG. 1 schematically illustrates a gas turbine engine embodiment.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 57 of the engine static structure 36 is arranged generally between the high pressure turbine 54 and the low pressure turbine 46. The mid-turbine frame 57 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 57 includes vanes 59, which are in the core airflow path and function as an inlet guide vane for the low pressure turbine 46. Utilizing the vane 59 of the mid-turbine frame 57 as the inlet guide vane for low pressure turbine 46 decreases the length of the low pressure turbine 46 without increasing the axial length of the mid-turbine frame 57. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed", as disclosed herein according to one non-limiting embodiment, is less than about 1150 ft/second.

Figure 2:
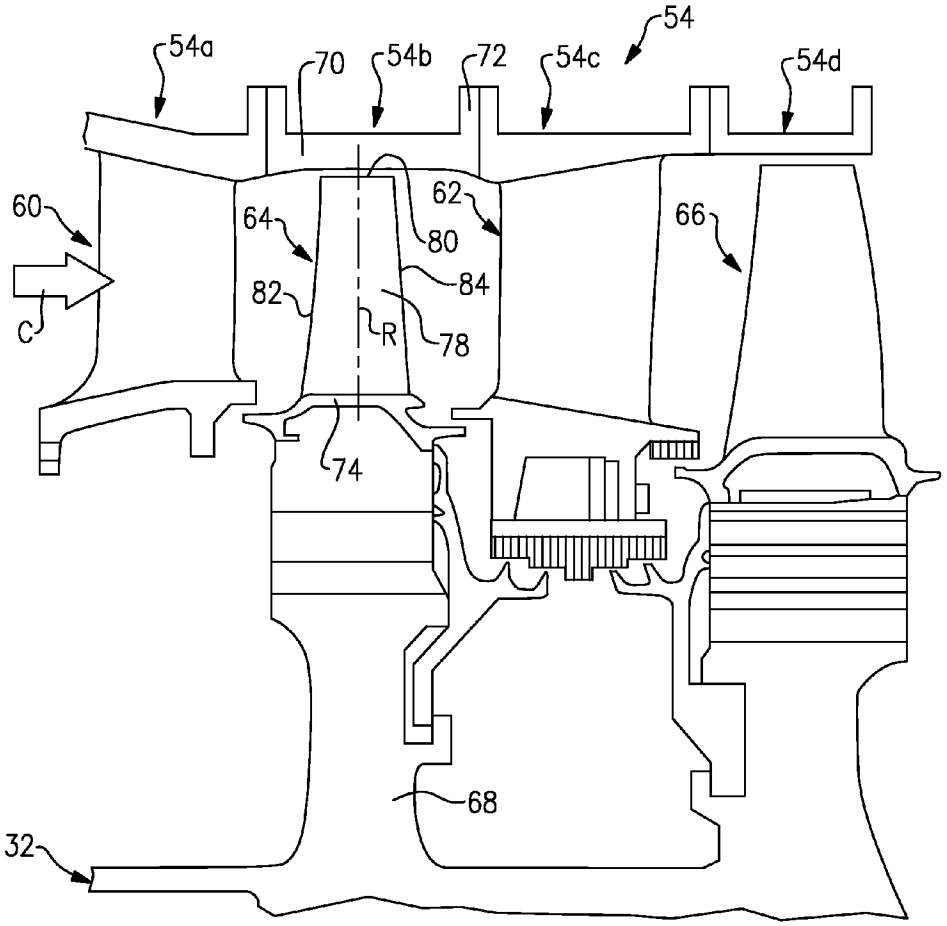
FIG. 2 is a cross-sectional view through a high pressure turbine section.

Referring to FIG. 2, a cross-sectional view through a high pressure turbine section 54 is illustrated. In the example high pressure turbine section 54, first and second arrays 54*a*, 54*c* of circumferentially spaced fixed vanes 60, 62 are axially spaced apart from one another. A first stage array 54*b* of circumferentially spaced turbine blades 64, mounted to a rotor disk 68, is arranged axially between the first and second fixed vane arrays 54*a*, 54*c*. A second stage array 54*d* of circumferentially spaced turbine blades 66 is arranged aft of the second array 54*c* of fixed vanes 62.

The turbine blades each include a tip 80 adjacent to a blade outer air seal 70 of a case structure 72. The first and second stage arrays 54*a*, 54*c* of turbine vanes and first and second stage arrays 54*b*, 54*d* of turbine blades are arranged within a core flow path C and are operatively connected to the high speed spool 32.

Each turbine blade includes a platform 74 defining an inner flow path. The platform 74 supports an airfoil 78 extending in a radial direction R that is normal to the axis A. The radial direction R also provides a radial plane that extends from the forward edge of the root 86 to the aft edge of the root 86, bisecting the root 86 into mirrored lateral halves. The airfoil 78 includes a concave pressure side and a convex suction side joined at opposing leading and trailing edges 82, 84.

Figure 3:
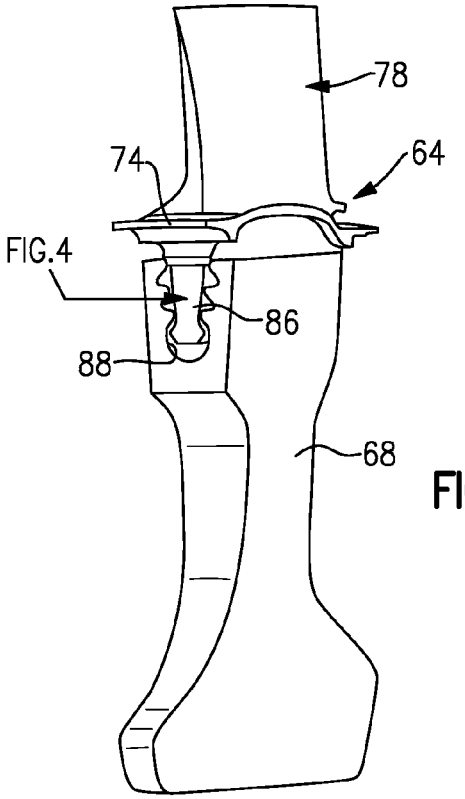
FIG. 3 is a partial sectional view of a turbine rotor supporting a turbine blade.

Referring to FIG. 3, the blade 64 includes a root 86 received in a generally correspondingly shaped slot 88 within the rotor 68. The root 86 extends from the platform 74 in the radial direction R on an opposite side of the platform 74. In the example, the root 86 provides a firtree-shaped contour having opposing lateral sides that are mirrored contours of one another.

Figure 4:
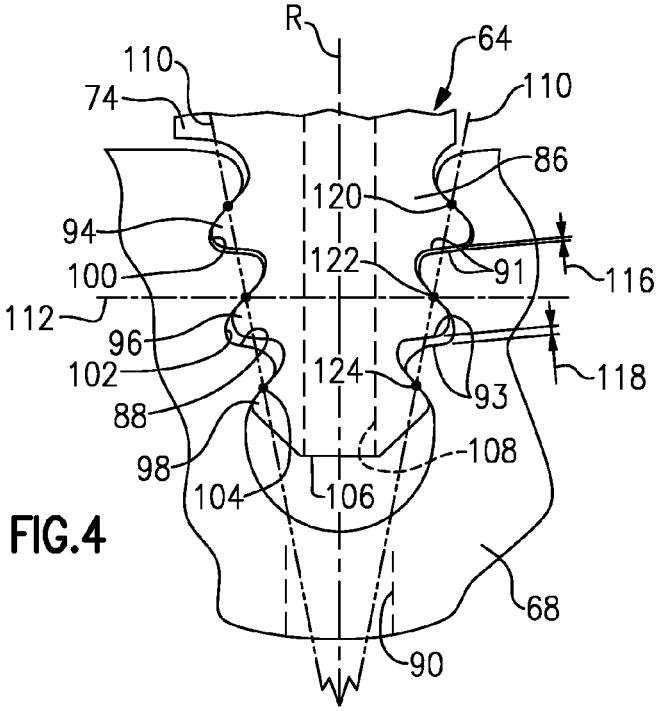
FIG. 4 is an enlarged end view of a turbine blade root within a rotor slot.

The root and slot configuration is illustrated in more detail in FIG. 4, which is an end view in the direction illustrated in FIG. 3. Each lateral side includes exactly three lobes: first, second and third lobes 94, 96, 98 respectively received in first, second and third slots 100, 102, 104. The lobes and slots include first and second faces 91, 93 that are spaced apart and generally parallel to one another. The faces 91, 93 are approximately 85°-90° relative to the radial plane R. A second clearance 118 provided between the second faces 93 of the second lobe 96 and its corresponding second slot 102 is approximately three times larger than a first clearance 116 provided between the first faces 91 of the first lobe 94 and its corresponding first slot 100.

The third lobe 98 is adjacent to a terminal end 106. A cooling passage 108 extends from the terminal end 106 radially into the airfoil 78 (not shown in the Figures for clarity). A cooling passage 90 in the rotor 68 communicates cooling flow to the cooling slot 108 from, for example, a compressor bleed air source.

A contact plane 110 intersects the first, second and third lobes 94, 96, 98 to respectively provide first, second and third contact points 120, 122, 124. An intersecting plane 112 is normal to the radial plane R and intersects the second contact points 122.

Figure 5:
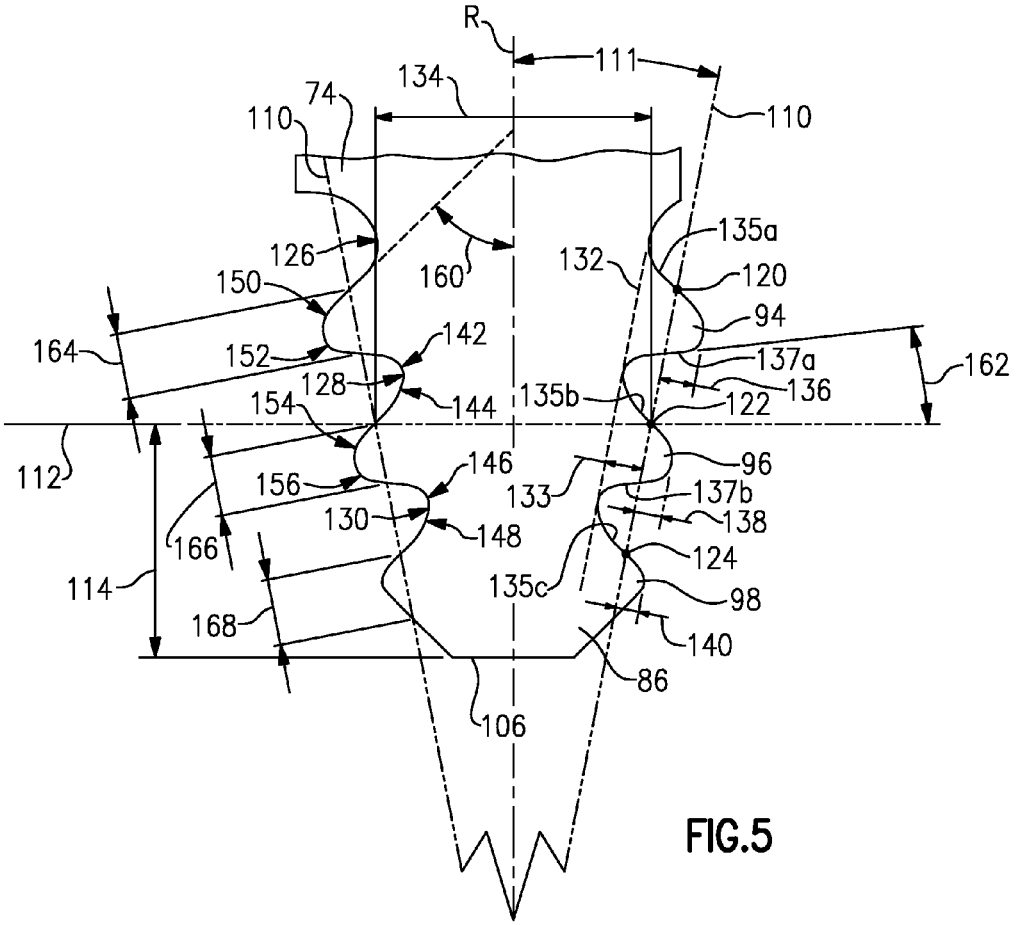
FIG. 5 is an enlarged view of the turbine blade root.

Referring to FIG. 5, the first, second and third lobes 94, 96, 98 are respectively provided by first, second and third grooves 126, 128, 130. The first groove 126 is adjacent to the platform 74. The first, second and third grooves 126, 128, 130 are substantially aligned (i.e., within 0.003 inch (0.08 mm) of one another) and tangential to an offset plane 132 that is spaced a uniform offset distance 133 from the contact plane 110. The contact plane 110 is oriented at a contact angle 111 relative to the radial plane R at about 11°, for example, 11°+/−0.5°, such that the root 86 tapers relative to the radial plane R away from the platform 74.

The first, second and third lobes 94, 96, 98 extend beyond the contact plane 110 respectively first, second and third lobe lengths 136, 138, 140. The second lobe length 138 is greater than the third lobe length 140, and the first lobe length 136 is greater than the second lobe length 138. In one example, the second lobe length 138 is 77-82% of the first lobe length 136, and the third lobe length 140 is 62-71% of the first lobe length 136.

The first, second and third lobes 94, 96, 98 respectively include contact surfaces 135A, 135B, 135C that are arranged at an angle 160 that is about 45° relative to the radial plane R, for example, 45°+/−1°. The contact surfaces 135A, 135B, 135C are planar and respectively include the first, second and third contact points 120, 122, 124.

The second contact points 122 are spaced apart from one another along the intersecting plane 112 at a contact point distance 134. The intersecting plane 112 is spaced from the terminal end 106 a distance 114. The ratio of the contact point distance 134 to the distance 114 is 1.15-1.25, and in one example 1.19.

The second groove 128 includes a compound radius at its valley provided by first and second slot radii 142, 144. The third groove 130 is provided by a compound radius defined by third and fourth slot radii 146, 148. In the example, the first and third slot radii 142, 146 are the same. The ratio of the second slot radius 144 to the first slot radius 142 is about 2.5, and the ratio of the fourth slot radius 148 to the third slot radius 146 is 2.7. The ratios between the radii disclosed above may vary by +/−10%.

The first lobe 94 is defined by a compound radius at its peak provided by first and second lobe radii 150, 152. The second lobe 96 is defined by a compound radius at its peak provided by third and fourth lobe radii 154, 156. In the example, the second and fourth lobe radii 152, 156 are the same. The ratio of the first lobe radius 150 to the second lobe radius 152 is about 1.5, and the ratio of the ratio of the third lobe radius 154 to the fourth lobe radius 156 is about 1.3. The ratios between the radii disclosed above may vary by +/−10%.

The first and second lobes 94, 96 respectively include non-bearing surfaces 137A, 137B arranged opposite the contact surfaces 135A, 135B. The non-bearing surfaces 137A, 137B are at an angle 162 relative to the intersecting plane 112 that is about 5°, for example, 5°+/−0.5°.

The first, second and third roots 94, 96, 98 respectively include first, second and third tooth heights, 164, 166, 168 that lie in the contact plane 110. In one example, the first tooth height 164 is greater than the third tooth height 168, which is greater than the second tooth height 166. In one example, a ratio of the first tooth height 164 to the second tooth height 166 is in the range of 1.060-1.070, and in one example, 1.65. A ratio of the first tooth height 164 to the third tooth height 168 is in the range of 1.005-1.015, and in one example, 1.010.

The disclosed root geometry provides a contour that securely attaches the turbine blade root 86 to the rotor slot 88 to better withstand centrifugal force, thermal expansion and bending stresses on the turbine blade.

Although an example embodiment has been disclosed, a worker of ordinary skill in this art would recognize that certain modifications would come within the scope of the claims. For that reason, the following claims should be studied to determine their true scope and content.

What is claimed is:

1. A turbine blade for a gas turbine engine comprising:

an airfoil extending in a first radial direction from a platform; and a root extending from the platform in a second radial direction and having opposing lateral sides providing a firtree-shaped contour, the contour including first, second and third lobes on each of the lateral sides and that tapers relative to the radial direction away from the platform, the first, second and third lobes each provide contact surfaces arranged at about 45° relative to the radial direction, and a contact plane on each lateral side at an angle of about 11° relative to the radial direction defining a contact point on each of the contact surfaces, the first, second and third lobes each include first, second and third grooves that are substantially aligned with one another along an offset plane spaced a uniform offset distance from the contact plane.

2. The turbine blade according to claim 1, wherein the second lobe is arranged radially between the first and third lobes, the contact points on the second lobe align in an intersecting plane spaced apart from a terminal end of the root a distance, the third lobe adjacent to the terminal end, the second lobe contact points spaced apart a contact point distance, a ratio of the contact point distance to the distance is 1.15:1-1.25:1.

3. The turbine blade according to claim 2, comprising a cooling passage extending from the terminal end in the radial direction from the root into the airfoil.

4. The turbine blade according to claim 1, wherein the first, second and third lobes respectively extend first, second and third lengths beyond the contact plane, the second length greater than the third length, the first length greater than the second length, and the first, second and third lobes respectively include first, second and third tooth heights lying in the contact plane.

5. The turbine blade according to claim 4, wherein the second length is 76-82% of the first length.

6. The turbine blade according to claim 4, wherein the third length is 62-71% of the first length.

7. The turbine blade according to claim 4, wherein the first tooth height is a distance between the two points of intersection of the first lobe and the contact plane, the second tooth height is a distance between the two points of intersection of the second lobe and the contact plane, the third tooth height is a distance between the two points of intersection of the third lobe and the contact plane, and a ratio of the first tooth height to the second tooth height is in the range of 1.060:1-1.070:1, and a ratio of the first tooth height to the third tooth height is in the range of 1.005:1-1.015:1.

8. The turbine blade according to claim 1, wherein the second and third grooves are provided by a compound radius.

9. The turbine blade according to claim 8, wherein the second groove includes first and second radii, wherein a ratio of the second radius to the first radius is about 2.5:1.

10. The turbine blade according to claim 8, wherein the third groove is provided by third and fourth radii, a ratio of the fourth radius to the third radius is about 2.7:1.

11. The turbine blade according to claim 8, wherein the second groove is provided by first and second radii, and the third groove is provided by third and fourth radii, the first and third radii the same.

12. The turbine blade according to claim 1, wherein the first and second lobes are provided by a compound radius.

13. The turbine blade according to claim 12, wherein the first lobe is provided by first and second radii, a ratio of first radius to the second radius is about 1.5:1.

14. The turbine blade according to claim 12, wherein the second lobe is provided by third and fourth radii, a ratio of the third radius to the fourth radius is about 1.3:1.

15. The turbine blade according to claim 12, wherein the first lobe is provided by first and second radii, the second lobe is provided by third and fourth radii, the second and fourth radii the same.

16. The turbine blade according to claim 1, wherein the first and second lobes include non-bearing surfaces opposite the contact surfaces, the non-bearing surfaces at about 5° relative to an intersecting plane normal to the radial direction.

17. A gas turbine engine comprising:

a compressor and turbine sections rotatable about an axis, and combustor section provided axially between the compressor and turbine sections;

wherein the turbine section includes a rotor having a slot, and a turbine blade including an airfoil extending in a first radial direction from a platform, and a root of the turbine blade received in the slot and extending from the platform in a second radial direction and having opposing lateral sides providing a firtree-shaped contour, the contour including first, second and third lobes on each of the lateral sides and that tapers relative to the radial direction away from the platform, the first, second and third lobes each provide contact surfaces arranged at about 45° relative to the radial direction, and a contact plane on each lateral side at an angle of about 11° relative to the radial direction defining a contact point on each of the contact surfaces, the first, second and third lobes each include first, second and third grooves that are substantially aligned with one another along an offset plane spaced a uniform offset distance from the contact plane.

18. The gas turbine engine according to claim 17, wherein the first, second and third lobes respectively extend first, second and third lengths beyond the contact plane, the second length greater than the third length, the first length greater than the second length, and the first, second and third lobes respectively include first, second and third tooth heights lying in the contact plane.

19. The gas turbine engine according to claim 18, wherein the first tooth height is a distance between the two points of intersection of the first lobe and the contact plane, the second tooth height is a distance between the two points of intersection of the second lobe and the contact plane, the third tooth height is a distance between the two points of intersection of the third lobe and the contact plane, a ratio of the first tooth height to the second tooth height is in the range of 1.060:1-1.070:1, and a ratio of the first tooth height to the third tooth height is in the range of 1.005:1-1.015:1.

20. The gas turbine engine according to claim 17, wherein the second lobe is arranged radially between the first and third lobes, the contact points on the second lobe align in an intersecting plane spaced apart from a terminal end of the root a distance, the third lobe adjacent to the terminal end, the second lobe contact points spaced apart a contact point distance, a ratio of the contact point distance to the distance is 1.15:1-1.25:1.

21. The gas turbine engine according to claim 20, wherein the second and third grooves are provided by a compound radius.

22. The gas turbine engine according to claim 20, wherein the first and second lobes are provided by a compound radius.

23. The gas turbine engine according to claim 17, wherein the first and second lobes include non-bearing surfaces opposite the contact surfaces, the non-bearing surfaces at about 5° relative to an intersecting plane normal to the radial direction.

24. The gas turbine engine according to claim 23, wherein the non-bearing surfaces of the first and second lobes are spaced from the rotor to provide first and second clearances respectively, wherein the first clearance is the distance between the non-bearing surface of the first lobe and a surface of the rotor opposing the non-bearing surface of the first lobe, and the second clearance is the distance between the non-bearing surface of the second lobe and a surface of the rotor opposing the non-bearing surface of the second lobe, the second clearance approximately three times larger than the first clearance.

25. The gas turbine engine according to claim 23, wherein the non-bearing surface of the first lobe is radially farther from the platform than the contact surface of the first lobe; and the non-bearing surface of the second lobe is radially farther from the platform than the contact surface of the second lobe.

* * * * *